US005432258A

United States Patent [19]

Yoshimura

[11] Patent Number: 5,432,258

[45] Date of Patent: Jul. 11, 1995

[54] TRANSFER PAPER

[75] Inventor: Yasuyuki Yoshimura, Ibaraki, Japan

[73] Assignee: Sakura Color Products Corporation, Osaka, Japan

[21] Appl. No.: 271,908

[22] Filed: Jul. 8, 1994

[30] Foreign Application Priority Data

Jul. 19, 1993 [JP] Japan ..... 5-178309

[51] Int. Cl.[6] ..... B41M 5/00

[52] U.S. Cl. ..... 428/414; 428/195; 428/207; 428/211; 428/345; 428/352; 428/353; 428/355; 428/356; 428/423.1; 428/500; 428/502; 428/503; 428/505; 428/913; 428/914

[58] Field of Search ..... 156/239, 240; 428/195, 428/203, 204, 211, 913, 914, 343, 345, 352, 353, 355, 356, 413, 414, 423.1, 500, 502, 503, 504, 505

[56] References Cited

U.S. PATENT DOCUMENTS 4,902,364 2/1990 Parker et al. ..... 156/233
5,073,423 12/1991 Johnson et al. ..... 428/40
5,102,497 4/1992 Hamaguchi et al. ..... 156/656

*Primary Examiner*—B. Hamilton Hess
*Attorney, Agent, or Firm*—Larson and Taylor

[57] ABSTRACT

The invention provides a transfer paper which comprises a releasable base and as disposed successively thereon at least one picture printing layer, a thermosetting adhesive layer and a release layer, and a transfer process employing the above transfer paper which comprises peeling off the releasable base from the paper, transferring the printing layer and thermosetting adhesive layer as a unit to a substrate and curing the adhesive layer at a temperature of 80°-170° C.

11 Claims, 2 Drawing Sheets

TRANSFER PAPER

TECHNICAL FIELD

The present invention relates to a transfer paper. The transfer paper of the invention is particularly useful in design transfer or decalcomania for decorating ceramics (mugs, tea cups, etc.), glassware (cups, bowls, etc.) and metal ware, etc. with patterns.

Throughout the specification, "%" and "parts" are "weight %" and "parts by weight", respectively.

BACKGROUND ART

In the transfer of a design or picture to the surface of a ceramic article or like bare product, it is common practice to use a water slide technique. According to the technique, a water-soluble size or paste layer is first formed on a release paper, a multicolor picture layer is formed thereon and, where necessary, a picture-supporting layer is further disposed on the picture layer to provide a transfer paper. In transfer printing, the thus-obtained transfer paper is wetted with water to dissolve out the water-soluble size and, hence, let the picture layer leave from the release paper, whereupon the picture layer is slide-transferred to the surface of a ceramic or other substrate. Then, using a squeezee and like tools, water between the picture layer and the substrate ware is squeezed out. The substrate ware is allowed to stand for drying the picture layer. After completion of drying, the ware is calcined at as high as about 1000° C. to parmanently fix the design or picture thereto.

However, this technique has the disadvantage that since a step for high-temperature calcining at about 1000° C. is essential, the use of heat-labile coloring materials, which are rich in colors, color tones, etc., is limited.

Japanese Unexamined Patent Publication 252,600/1990 discloses "a transfer paper comprising a release paper or film base carrying thereon a water-soluble size or releaser, a supporting layer disposed on said base and capable of maintaining the shape of a picture layer to be transferred and, as formed thereon, a picture layer comprising a printing layer selected having a B stage so as to insure a greater bond strength with to a substrate ware than the bond strength to said supporting layer" and a transfer process employing said transfer paper.

In the process, calcining or curing the printing layer is performed at a temperature of 80°–300° C. and, therefore, the above-mentioned problem associated with high-temperature calcination is overcome. However, when the process is applied to multicolor decalcomania, it takes a long time for the printing layer to establish the B stage, with the result that the efficiency of production of the transfer paper is inevitably low.

Furthermore, when the printing layer is calcined at a relatively low temperature of 80°–170° C., a sufficient degree of cure can be achieved only after prolonged heating leading to an inadequate adhesion of the printing layer to the substrate ware. There also is the disadvantage that the water resistance of the picture to water, in particular, to warm water is low.

It is a primary object of the invention to provide a novel transfer paper which permits the use of heat-labile coloring materials and enables multicolor decalcomania at a comparatively low temperature without procedural complexity.

It is a further object of the invention to provide a novel transfer process which affords multicolor decalcomania at a comparatively low temperature without procedural complexity.

Other objects and advantages of the invention will become apparent in view of the following description.

SUMMARY OF THE INVENTION

The inventors have conducted research in view of the prior art and found that the use of a thermosetting adhesive cured at a specified temperature as a bonding material between a printing layer and a substrate ware results in a substantial elimination or drastic alleviation of the problems of the prior art.

Thus, the invention provides the following transfer paper and transfer process.

1. A transfer paper comprising a releasable base and, as disposed successively thereon, at least one of picture printing layer, a thermosetting adhesive layer and a release layer.
2. A process of transfer printing using said transfer paper comprising peeling off the releasable base from said paper, transferring said printing layer and thermosetting adhesive layer as a unit to a substrate ware, and curing said adhesive layer at a temperature of 80°–170° C.

DETAILED DESCRIPTION OF THE INVENTION

Figure 1:
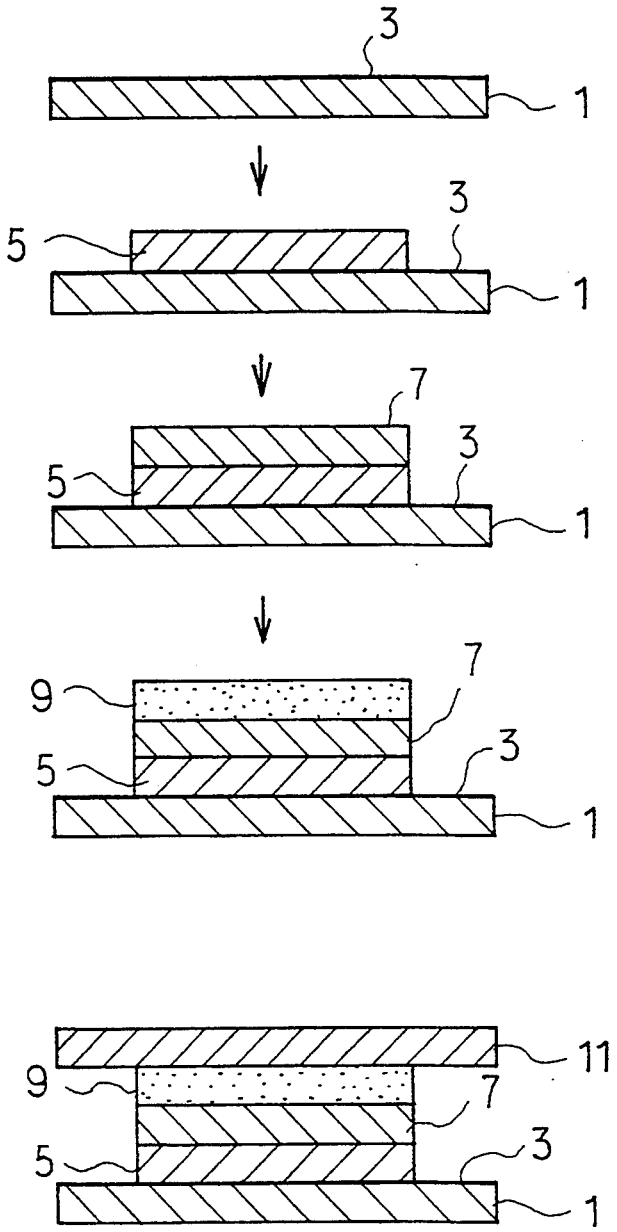
FIG. 1 is a schematic sectional view illustrating a process for manufacture of the transfer paper according to the invention and an exemplary construction of said paper.

The releasable base (hereinafter referred to briefly as the base) of the invention can be a paper or a film made of polyethylene, polypropylene, polyethylene terephthalate, polyvinyl chloride, polybutene, polybutadiene, polyurethane, polymethylpentene, ethylenevinyl acetate copolymer and other films, on which a known release material such as acrylic, silicone, vinyl, polyester, urethane, polyolefin and other release materials are coated. Among the release materials mentioned above, acrylic release materials with Tg values of not below 100° C. are more preferable. A thickness of the base, is not limited to but, generally ranges from about 50 to about 125 μm.

The printing layer on the base is formed by printing the base with a known ultraviolet-curing ink, oil based ink, cold setting ink, reversible thermochromic ink or the like according to screen printing, offset printing or other technique, followed by subjecting the printing layer to ultraviolet irradiation, drying or the like according to the properties of the ink.

A resin component of the ultraviolet-curing ink is not particularly limited but includes the following.

Photopolymerizable prepolymers such as polyether (meth)acrylate, urethane (meth)acrylate, epoxy (meth)acrylate, polyester (meth)acrylate, oligo(-meth)acrylate, alkyd (meth)acrylate, polyol (meth-)acrylate, etc. Mono/polyfunctional reactive monomers such as 2-ethylhexyl acrylate, 2-hydroxyethyl acrylate, 2-hydroxypropyl acrylate, 2-hydroxyethyl acryloyl phosphate, tetrahydrofurfuryl acrylate, aclylate of tetrahydrofurfuryl derivative, dicyclopentenyl acrylate, dicyclopentenyloxyethyl, 1,3-butanediol diacrylate, 1,4-butanediol diacrylate, 1,6-hexanediol diacrylate, diethylene glycol diacrylate, neopentyl glycol diacrylate, polyethylene glycol 400 diacrylate, hydroxypivalic acid ester neopentyl glycol diacrylate, tripropylene glycol diacrylate, 1,3-bis(3″-acryloxyethoxy-2′-hydroxypropyl)-5,5-dimethylhydantoin, diacrylate of hydroxypivalic acid ester neopentyl glycol derivative, trimethylolpropane triacrylate, pentaerythritol triacrylate, pentaerythritol hexacrylate, etc.

Photopolymerization initiators such as biacetyl, acetophenone, benzophenone, Michler's ketone, benzil, benzoin, benzoin isobutyl ether, benzyl methyl ketal, tetramethylthiuram sulfide, azobisisobutyronitrile, benzoyl peroxide, di-tert-butyl peroxide, 1-hydroxycyclohexyl phenyl ketone, 2-hydroxy-2-methyl-1-phenylpropan-1-one, 1-(4-isopropylphenyl)-2-hydroxy-2-methylpropan-1-one, 2-chlorothioxanthone, methylbenzoyl formate, etc.

The coloring material may be any of the known inorganic pigments, organic pigments and thermochromic pigments, for instance.

The ultraviolet-curing ink is preferably a composition comprising (a) 20–90 parts by weight of at least one member selected from the group consisting of urethane (meth)acrylates in the molecular weight range of about 500–50000 and polyester (meth)acrylates in the molecular weight range of about 500–50000, (b) 80–10 parts by weight of at least one mono/polyfunctional reactive monomer, and based on the above total of 100 parts by weight, (c) 1–15 parts by weight of at least one photopolymerization initiator selected from the group consisting of acetophenone, benzophenone and thioxanthone type initiators. Said composition preferably containes 60–95 weight % of (a), (b) and (c) combined and 40–5 weight % of a pigment component.

The ultraviolet-curing ink may further contain, in addition to the above resin component and coloring material (inorganic pigment, organic pigment, thermochromic or other pigment), such other additives as a sensitizer, filler, inert organic polymer, leveling agent, thixotropic agent, thermopolymerization inhibitor, solvent and so on.

The oil based ink essentially comprises an evaporation-drying type resin component showing a good bonding affinity for the substrate, such as an acrylic, epoxy, urethane or other resins, a solvent component such as an aliphatic hydrocarbons, aromatic hydrocarbons, alcohols, glycols, ketones, esters or ethers, and a coloring material such as an inorganic pigment, organic pigment, thermochromic pigment, etc.

The cold setting ink essentially comprises a resin system containing a base resin and a curing agent, and a coloring material (an inorganic pigment, organic pigment, thermochromic pigment, etc.). In addition, the ink may contain a cure accelerator, curing catalyst, reactive diluent and stabilizer, etc., where necessary. The combination of the base resin and the curing agent in cold setting ink is not particularly limited to but includes the following, for instance.

* Base resin—epoxy resins and modified expoxy resins Curing agent—aliphatic amines, alicyclic amines, aromatic amines, polyamides, amine adducts, polysulfides, acid anhydrides, etc.
* Base resin—acrylic resins and modified acrylic resins Curing agent—divalent and multivalent metals, metal oxides, etc.
* Base resin—urethane resins and modified urethane resins Curing agent—polymines, polycarboxylic acids, hydroxy-terminated polyesters In the invention, known reversible thermochromic ink compositions can be used to print on the substrate or in superposition on the printing layer formed with the above-mentioned ink. The reversible thermochromic ink composition comprises an electrondonating chromogenic organic compound (color producing agent), an electron-accepting compound (developer) and a desensitizer, and such compositions are described in a variety of publications. The species of such a color producing agent, developer and desensitizer constituting reversible thermochromic compositions are not limited to, but those mentioned in Japanese Unexamined Patent Publication 174,591/1989 are useful. Such compositions may have been microencapsulated.

If necessary, a silane coupling agent may be incorporated in any of the above inks so as to enhance bond strength between the picture layer and the substrate. The same object can also be accomplished by dipping the substrate in an aqueous solution of the silane coupling agent. The silane coupling agent includes epoxysilanes, aminosilanes, vinylsilanes, acrylsilanes, $\gamma$-chloropropyltrimethoxysilanes etc. Epoxysilane and aminosilane type coupling agents are preferred. The silane coupling agent is formulated preferably about 0.05–10%, more preferably about 1–5% relative to a weight of the ink.

The thermosetting adhesive layer according to the invention is provided using a thermosetting adhesive composition essentially comprising about 0.01–5 parts of a crosslinking or curing agent (hereinafter referred to as the crosslinking agent) and about 0.1–20 parts of a thermosetting resin per 100 parts of an alkyl (meth)acrylate polymer. The adhesive composition may contain, if necessary, an $\alpha,\beta$-unsaturated carboxylic acid in lieu of part of said polymer (up to about 15%), in which case adhesion and tackiness of the composition are improved. The $\alpha,\beta$-unsaturated carboxylic acid includes (meth)acrylic acid, iraconic acid, maleic acid and fumaric acid, etc.

The number of carbon atoms in the alkyl ester moiety of said alkyl (meth)acrylate polymer may range from 1 to about 14. If the carbon number exceeds 14, no sufficient adhesion can be obtained due to glass transition temperature (Tg). The carbon number of the alkyl ester moiety is preferably about 4–12. From the standpoint of adhesion and heat resistance, the molecular weight of said alkyl (meth)acrylate polymer is generally about $3\times10^5$ to $1\times10^6$, preferably about $4\times10^5$ to $1\times10^6$. Examples of the alkyl (meth)acrylate polymer are butyl(meth)acrylate polymer and 2-ethylhexyl (meth)acrylate polymer.

The crosslinking agent in the thermosetting adhesive composition of the invention reacts with the hydroxyl and carboxyl groups of said polymer and $\alpha,\beta$-unsaturated carboxylic acid to enhance and stabilize adhesion and cohesive force of the composition. The crosslinking agent includes isocyanate, epoxy, metal and N-methylol type crosslinking agents. Particularly preferred are isocyanate type crosslinking agents such as toluylene diisocyanate, xylylene diisocyanate, hexamethylene diisocyanate, isopropylene diisocyanate, trimethylhexamethylene diisocyanate, isophorone diisocyanate and so on. Said crosslinking agent is formulated in an amount of about 0.01–0.5%, preferably about 0.5–3%, based on the weight of the polymer or the total weight of the polymer and $\alpha,\beta$-unsaturated carboxylic acid as nonvolatile matter. If the amount of the crosslinking agent is too small, no sufficient cohesive force will be attained. On the other hand, with an excessive amount of the crosslinking agent, the adhesion thereof is decreased.

The thermosetting resin incorporated in the thermosetting adhesive composition of the invention undergoes crosslinking reaction with the hydroxyl and carboxyl groups of said polymer, $\alpha,\beta$-unsaturated carboxylic acid and resin component of said ink to provide a firm bond with the substrate ware. The thermosetting resin includes epoxy resin, melamine resin, urea resin and modified resin thereof. Epoxy and modified epoxy resins such as bisphenol A type epoxy resin, bisphenol F type epoxy resin, novolak type epoxy resin, brominated epoxy resin, polyglycol type epoxy resin, etc. are particularly preferred. The epoxy or modified epoxy resins preferably has a molecular weight of about 200–5000 and an epoxy equivalent of about 100–1000. The thermosetting resin is formulated generally in an amount of about 0.1–20%, preferably about 0.1–15%, based on the weight of said alkyl (meth)acrylate polymer or the total weight of said alkyl (meth)acrylate polymer and $\alpha,\beta$-unsaturated carboxylic acid. When the amount of thermosetting resin is too small, no sufficient enhancement of adhesion can be achieved.

The thermosetting adhesive composition of the invention may contain, where necessary, a vinyl monomer for further improvement in adhesion and cohesive force. The vinyl monomer includes, but is not limited to, alkyl (meth)acrylate having 1–14 carbon atoms, such as methyl (meth)acrylate, ethyl (meth)acrylate, isopropyl (meth)acrylate, 2-ethylhexyl (meth)acrylate, etc.; hydroxy-containing unsaturated monomers such as 2-hydroxyethyl (meth)acrylate, 2-hydroxypropyl (meth-)acrylate, diethylene glycol monoacrylate, etc.; styrene-type monomers such as styrene, vinyltoluene, chlorostyrene, etc.; carboxyl group-containing unsaturated acids such as acrylic acid, methacrylic acid, itaconic acid, maleic acid, etc.; other ethylene-type unsaturated monomers such as vinyl acetate etc.; and amino-, glycidyl-, or other functional group-containing unsaturated monomers. For the same purpose as above, rosin-type resin, terpene resin, aliphatic petroleum resin, aromatic petroleum resin, alicyclic petroleum resin, coumarone resin, styrene resin, alkylphenol resin, xylene resin, etc. which have Tg values not below 80° C. can be incorporated.

The thermosetting adhesive composition of the invention is applied to the printing layer, generally in the form of a solution in an organic solvent. The solvent includes ketones such as acetone, diethyl ketone, cyclohexane, etc.; esters such as methyl acetate, ethyl acetate, butyl acetate, etc.; ethers such as ethylene glycol monomethyl ether etc.; aromatic hydrocarbons such as benzene, toluene, xylene, etc.; and aliphatic hydrocarbons such as hexane, heptane and so on. These solvents can be used alone or in combination. The concentration of the thermosetting adhesive composition in solution can be adjusted according to the intended use.

The construction of the transfer paper of the invention and the process for its manufacture are now described in detail with reference to the drawing.

As shown in sectional view in FIG. 1, a base 1 is coated with a release composition in the conventional manner (screen printing, coating, etc.) and the solvent is evaporated to form a release layer 3. The evaporation of the solvent can be carried out, but is not limited to, by air-drying (about 10–30 minutes at room temperature), forced drying (e.g. about 1–5 minutes at 60° C.), etc.

Then, a plurality of picture patterns are reverse-printed on the release layer 3 by the conventional technique (screen printing, offset printing, etc.) and subjected to ultraviolet irradiation or thermal drying according to the type of resin component in the ink used, whereby the resin component is cured to give picture printing layers 5, 7. The number of picture printing layers can be selected according to the desired design.

Thereafter, said thermosetting adhesive composition is coated on the picture printing layer 7 in the conventional manner (e.g. screen printing, offset printing, etc.), by evaporating off the solvent, followed by applying a release paper 11 on the picture printing layer 7 to form a thermosetting adhesive layer 9. The release sheet is not limited to in type but the conventional paper-releaser assemblies can be utilized. The conditions for evaporation of the solvent can also be freely selected according to the type of solvent but may, for example, be about 1–5 minutes at 80° C.

Figure 2:
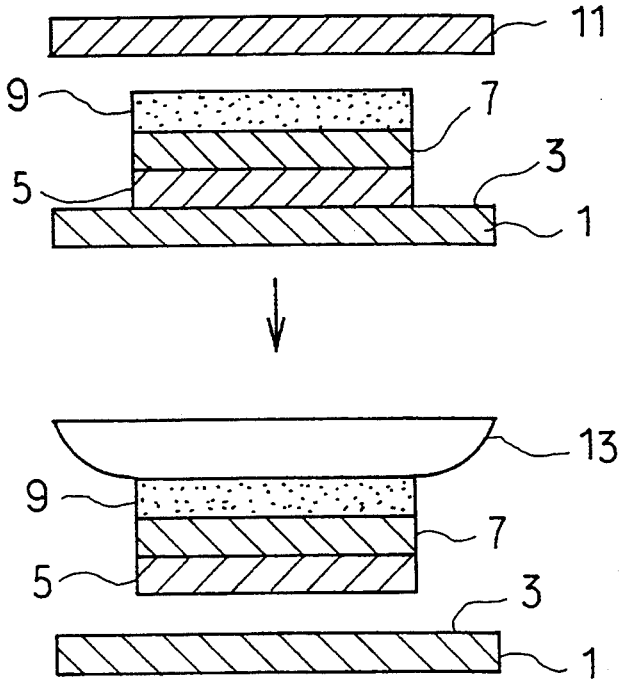
FIG. 2 is a schematic sectional view showing a manner of use of the transfer paper according to the invention.

In use, the thus-obtained transfer paper is punched and half-cut to provide a necessary picture. As shown in FIG. 2, the release paper 11 is then peeled off and the thermosetting adhesive layer 9 is applied to a substrate ware 13. Thereafter, the base 1 is peeled off and the ware 13 is heated in an oven to cure the thermosetting adhesive layer 9, whereby the picture is firmly fixed to the ware. The curing conditions can be suitably selected according to the type of resin of the thermosetting adhesive layer 9, which is sufficiently cured for about 1–30 minutes at 80°–170° C., preferably for about 10–20 minutes at 100°–130° C. When the curing temperature is below 80° C., the crosslinking reaction of the thermosetting resin is too slow to insure reasonable productivity. On the other hand, when the curing temperature is higher than 170° C., the appearance of the printing layer may be adversely affected by, for example, shrikage of the resin. Furthermore, where an $\alpha,\beta$-unsaturated carboxylic acid is incorporated, a high curing temperature may decompose $\alpha,\beta$-unsaturated carboxylic acid.

In the invention, ultrafine titanium oxide, an ultraviolet absorber or the like may be incorporated in the picture printing layer and/or releaser layer in the per se known manner, whereby photoresistance of the transfer paper and of the picture layer can be enhanced.

The following significant effects can be realized according to the invention.

(1) Since immersion in water of the transfer paper and the subsequent application to the substrate with a squeezee are not needed, a remarkable improvement in workability is realized so that the picture formation of the substrate ware can be mechanized.

(2) Since the picture layer in B to C stage is formed in a short time, multicolor decalcomania can be easily accomplished and the workability is also improved.

(3) Unlike the conventional technology using known adhesives, the thermosetting adhesive layer according to the invention is not temperature-dependent so that there occurs no such a trouble as displacement or detachment of the picture layer in use of the ware.

(4) Since the thermosetting adhesive layer is cured at low temperature in a short time, a high work effeciency can be obtained.
(5) Since the picture layer formed shows good adhesion to the substrate ware, it is remarkably durable even in the presence of water or warm water.
(6) The picture formed on the ware has a satisfactory gloss adding much to the marketability of the product ware.
(7) Since there is no blocking, the transfer paper has a long shelf-life.
(8) When a silane coupling agent is incorporated in the thermosetting adhesive layer, a further improvement is insured in the adhesion to the substrate ware.

EXAMPLES AND COMPARATIVE EXAMPLES

The following examples and comparative examples are intended to further illustrate the outstanding features of the invention in detail.

The releasable base and thermosetting adhesive compositions used in the examples and comparative examples were as follows.

I. Releasable base

An acrylic release composition was deposited on a 100 μm-thick clear PET film by screen printing and dried at room temperature to provide a releasable base.

II. Components of the thermosetting adhesive compositions (the materials other than those shown below are specifically described in the respective examples).

Acrylic ester copolymers (hereinafter referred to as polyacrylates)

Polyacrylate 1 . . . "SK Dyne 1313" (trade mark), product of Soken Kagaku K. K., nonvolatile matter=30%;

Polyacrylate 2 . . . "Nissetsu" (trade mark), product of Nippon Carbide Industries Co., Inc., nonvolatile matter=40%;

Polyacrylate 3 . . . "SK Dyne 100" (trade mark), product of Soken Kagaku K. K., self-curing type, nonvolatile matter=40%.

Thermosetting Resin

Thermosetting resin 1 . . . "Epikote 828" (trade mark), product of Yuka Shell Epoxy K. K., epoxy equivalent=about 189, molecular weight=about 380;

Thermosetting resin 2 . . . "Epikote 1001×75" (trade mark), product of Yuka Shell Epoxy K. K., epoxy equivalent=about 475, molecular weight=about 900.

Crosslinking Agent

Crosslinking agent 1 . . . "L-45" (trade mark), product of Soken Kagaku K. K., TDI-TMP adduct, nonvolatile matter=45%;

Crosslinking agent 2 . . . "E-AX" (trade mark), product of Soken Kagaku K. K., epoxy crosslinking agent, nonvolatile matter=5%;

Crosslinking agent 3 . . . "Coronate T" (trade mark), product of Nippon Polyurethane Industry Co., Ltd., TDI crosslinking agent, nonvolatile matter=75%.

Adhesion Imparting Agent

Adhesion imparting agent 1 . . . "Arkon P-125" (trade mark), product of Arakawa Chemical Industries Ltd., Tg=125° C., alicyclic saturated hydrocarbon Adhesion imparting agent 2 . . . "Arkon P-60" (trade mark), product of Arakawa Chemical Industries Ltd., Tg=60° C., alicyclic saturated hydrocarbon Silane coupling agent . . . "KBM703" (trade mark), product of Shin-Etsu Chemical Co., chloropropylmethoxysilanes

Coloring Pigment

Coloring pigment 1 . . . "820 Series Green" (trade mark), product of Sterling Industrial Colors Ltd., organic pigment;

Coloring pigment 2 . . . 820 Series Pink" (trade mark), product of Sterling Industrial Colors Ltd., organic pigment;

Coloring pigment 3 . . . "TC Powder Black 45" (trade mark), product of Sakura Color Products Co., thermochromic pigment;

Coloring pigment 4 . . . "TC Powder Blue 15" (trade mark), product of Sakura Color Products Co., thermochromic pigment.

Example 1

Using an ink composition of the following formula, a polka dot pattern was formed on a releasable base by screen reverse printing, followed by ultraviolet irradiation to form a design.

| | |
|---|---|
| Polyester acrylate (product of Toa Gosei Kagaku K.K., "Aronix M-700" (trade mark), molecular weight = about 1000) | 70.2 parts |
| 1,6-hexanediol diacrylate | 17.1 parts |
| Acetophenone photopolymerization initiator (product of Ciba-Geigy, "Irgacure 651" (trade mark)) | 1.8 parts |
| Thioxanthone photopolymerization initiator (product of Nippon Kayaku Co., Ltd., "Kayacure DETX" (trade mark)) | 0.9 parts |
| Coloring pigment 1 | 10.0 parts |

Using an applicator, a thermosetting adhesive composition was coated in a thickness of 20 μm on the above design and dried at 80° C. for 5 minutes. A release paper was superimposed thereon to provide a transfer paper.

| | |
|---|---|
| Polyacrylate 1 | 100 parts |
| Thermosetting resin 1 | 2 parts |
| Crosslinking agent 1 | 2 parts |

The release paper was peeled off from the transfer paper and the design was transferred to a ceramic substrate mug. After the releasable base was peeled off, the mug was heated at 100° C. for 20 minutes.

The thus-obtained mug carrying a polka dot pattern was excellent in bond strength and warm water resistance of the design as evidenced in Test Example 1 which appears hereinafter.

Moreover, when the transfer paper according to the example was stored for 6 months and, then, used in the same manner as above, it exhibited excellent bond strength and resistance to warm water which were comparable to those found immediately after manufacture.

Example 2

Using an ink composition of the following formula, a polka dot pattern was formed on a releasable base by screen reverse printing, followed by ultraviolet irradiation to form a design.

| | |
|---|---|
| Polyurethane acrylate (product of Nippon Kayaku Co., Ltd., "Kayarad UX-3204" (trade mark), molecular weight = about 1,100) | 40.0 parts |
| 2-Ethylhexyl acrylate | 20.0 parts |
| 1,6-Hexanediol diacrylate | 10.0 parts |
| Benzophenone photopolymerization initiator (product of Nippon Kayaku Co., Ltd., "Kayacure BMS" (trade mark)) | 2.5 parts |
| Thioxanthone photopolymerization initiator (product of Nippon Kayaku Co., Ltd., "Kayacure DETX" (trade mark)) | 0.5 part |
| Aminosilane coupling agent (product of Shin-Etsu Chemical Co., "KBM602" (trade mark) | 1.0 part |
| Coloring pigment 1 | 10.0 parts |
| Coloring pigment 3 | 20.0 parts |

Then, using an applicator, a thermosetting adhesive composition was coated in a thickness of 20 μm on the above design, and dried at 80° C. for 5 minutes. A release paper was superimposed thereon to provide a transfer paper.

| | |
|---|---|
| Polyacrylate 1 | 100 parts |
| Thermosetting resin 2 | 2 parts |
| Crosslinking agent 1 | 2 parts |

The release paper was peeled off from the transfer paper and the design was transferred to a ceramic substrate mug. After the releasable base was peeled off, the mug was heated at 120° C. for 10 minutes.

The resultant mug carrying a polka dot pattern was black at room temperature but when it was filled with warm water, the pattern turned brilliant fluorescent green. The bond strength of the pattern to the substrate mug as well as the resistance thereof to warm water was very satisfactory.

Moreover, when the transfer paper according to the example was stored for 6 months and, then, used in the same manner as above, it exhibited excellent bond strength and resistance to warm water which were comparable to those found immediately after manufacture.

Comparative Example 1

A transfer paper was manufactured in the same manner as Example 1 except that a hot-melt adhesive (trade mark "9940", Hitachi Kasei Polymer; EVA type) was used as the adhesive, and using a silicone rubber, the transfer paper was stuck to a substrate mug.

The transferred polka dot pattern showed a good bond strength with respect to the mug but was poor in resistance to warm water.

Comparative Example 2

A transfer paper was manufactured in the same manner as Example 1 except that the following composition was used as the thermosetting adhesive composition and the design was transferred to a substrate mug.

| | |
|---|---|
| Polyacrylate 3 | 100 parts |
| Thermosetting resin 1 | 2 parts |

The transferred polka dot pattern showed a good bond strength to the mug but was poor in resistance to warm water.

Comparative Example 3

A transfer paper was manufactured in the same manner as Example 1 except that the following composition was used as the thermosetting adhesive composition and the design was transferred to a substrate mug.

| | |
|---|---|
| Polyacrylate 3 | 100 parts |
| Thermosetting resin 2 | 2 parts |

The transferred polka dot pattern showed a good bond strength with respect to the mug but was poor in resistance to warm water.

Comparative Example 4

A transfer paper was manufactured in the same manner as Example 1 except that the following composition was used as the thermosetting adhesive composition and the design was transferred to a substrate mug.

| | |
|---|---|
| Polyacrylate 1 | 100 parts |
| Thermosetting resin 1 | 9 parts |
| Crosslinking agent 1 | 2 parts |

The transferred polka dot pattern had wrinkles, thus being poor in appearance, and was unsatisfactory in bond strength and warm water resistance.

Comparative Example 5

A transfer paper was manufactured in the same manner as Example 1 except that the following composition was used as the thermosetting adhesive composition and the design was transferred to a substrate mug.

| | |
|---|---|
| Polyacrylate 1 | 100 parts |
| Thermosetting resin 2 | 2 parts |
| Crosslinking agent 1 | 8 parts |

The transferred polka dot pattern was poor in bond strength and resistance to warm water.

Example 3

A transfer paper was manufactured in the same manner as Example 1 except that the following composition was used as the thermosetting adhesive composition and the design was transferred to a substrate mug.

| | |
|---|---|
| Polyacrylate 1 | 100 parts |
| Thermosetting resin 2 | 2 parts |
| Crosslinking agent 1 | 2 parts |
| Silane coupling agent | 1 part |

The thus-obtained mug carrying a polka dot pattern was excellent in bond strength and warm water resistance of the design.

The transfer paper obtained in the example showed no problem, even after 6 months of storage.

Example 4

A transfer paper was manufactured in the same manner as Example 1 except that the following composition was used as the thermosetting adhesive com position and the design was transferred to a substrate mug.

| | |
|---|---|
| Polyacrylate 1 | 90 parts |
| Thermosetting resin 1 | 1 part |
| Crosslinking agent 2 | 1 part |
| Adhesion imparting agent | 1 part |

The thus-obtained mug carrying a polka dot pattern was excellent in bond strength and warm water resistance of the design.

The transfer paper obtained in the example showed no problem, even after 6 months of storage.

Comparative Example 6

A transfer paper was manufactured in the same manner as Example 1 except that the following composition was used as the thermosetting adhesive composition and the design was transferred to a substrate mug.

| | |
|---|---|
| Polyacrylate 1 | 90 parts |
| Thermosetting resin 1 | 1 part |
| Crosslinking agent 2 | 1 part |
| Adhesion imparting agent 2 | 10 parts |

The transferred polka dot pattern showed a good bond strength to the mug but was poor in resistance to warm water.

Example 5

A transfer paper was manufactured in the same manner as Example 1 except that the following composition was used as the thermosetting adhesive composition and the design was transferred to a substrate mug.

| | |
|---|---|
| Polyacrylate 2 | 100 parts |
| Thermosetting resin 1 | 2 parts |
| Crosslinking agent 3 | 1 part |

The thus-obtained mug carrying a polka dot pattern was excellent in the bond strength and warm water resistance of the design.

The transfer paper obtained in the example showed no problem, even after prolonged storage.

Example 6

A transfer paper was manufactured in the same manner as Example 1 except that the following composition was used as the thermosetting adhesive composition and the design was transferred to a substrate mug.

| | |
|---|---|
| Polyacrylate 2 | 100 parts |
| Thermosetting resin 2 | 2 parts |
| Crosslinking agent 3 | 1 part |

The thus-obtained mug carrying a polka dot pattern was excellent in bond strength and warm water resistance of the design.

The transfer paper obtained in the example showed no problem, even after prolonged storage.

Comparative Example 7

A transfer paper was manufactured in the same manner as Example 1 except that the following composition was used as the thermosetting adhesive composition and the design was transferred to a substrate mug.

| | |
|---|---|
| Polyacrylate 2 | 100 parts |
| Thermosetting resin 2 | 8 parts |
| Crosslinking agent 3 | 1 part |

The polka dot pattern had wrinles, thus being poor in appearance, and was unsatisfactory in bond strength and resistance to warm water.

Comparative Example 8

A transfer paper was manufactured in the same manner as Example 1 except that the following composition was used as the thermosetting adhesive composition and the design was transferred to a substrate mug.

| | |
|---|---|
| Polyacrylate 2 | 100 parts |
| Thermosetting resin 2 | 2 parts |
| Crosslinking agent 3 | 6 parts |

The transferred polka dot pattern showed a good bond strength to the mug but was poor in resistance to warm water.

Example 7

A transfer paper was manufactured in the same manner as Example 1 except that the following composition was used as the thermosetting adhesive composition and the design was transferred to a substrate mug.

| | |
|---|---|
| Polyacrylate 2 | 100 parts |
| Thermosetting resin 1 | 2 parts |
| Crosslinking agent 3 | 1 part |
| Silane coupling agent | 1 part |

The thus-obtained mug carrying a polka dot pattern was excellent in bond strength and warm water resistance of the design.

The transfer paper obtained in the example showed no problem, even after prolonged storage.

Example 8

A transfer paper was manufactured in the same manner as Example 1 except that the following composition was used as the thermosetting adhesive composition and the design was transferred to a substrate mug.

| | |
|---|---|
| Polyacrylate 2 | 90 parts |
| Thermosetting resin 2 | 1 part |
| Crosslinking agent 3 | 1 part |
| Adhesion imparting agent 1 | 10 parts |

The thus-obtained mug carrying a polka dot pattern was excellent in bond strength and warm water resistance of the design.

The transfer paper obtained in the example showed no problem, even after prolonged storage.

Comparative Example 9

A transfer paper was manufactured in the same manner as Example 1 except that the following composition was used as the thermosetting adhesive composition and the design was transferred to a substrate mug.

| | |
|---|---|
| Polyacrylate 2 | 90 parts |
| Thermosetting resin 2 | 1 part |

-continued

| | |
|---|---|
| Crosslinking agent 3 | 1 part |
| Adhesion imparting agent 2 | 10 parts |

The transferred polka dot pattern showed a satisfactory bond strength to the mug but was poor in resistance to warm water.

Example 9

One-hundred parts of an epoxy resin ("Epikote 828" (trade mark), product of Yuka Shell Epoxy K. K.), 5 parts of a reactive diluent ("Cardura" (trade mark), product of Yuka Shell Epoxy K. K.), 0.5 part of a defoaming agent ("BYK-077" (trade mark), product of BYK Chemie Japan) and 40 parts of coloring pigment 1 were mixed under stirring, followed by adding 25 parts of a curing agent ("Epicure U" (trade mark), product of Yuka Shell Epoxy K. K.) and mixing to provide an ink composition.

Using the ink composition, a polka dot pattern was formed on a releasable base by screen reverse printing. The design cured at room temperature for fixation.

Then, the thermosetting adhesive composition used in Example 1 was coated and dried. A release paper was superimposed thereon to provide a transfer paper.

The release paper was peeled off from the transfer paper thus obtained and the design was transferred to a ceramic substrate mug. The releasable base was then peeled off and the mug was heated at 130° C. for 10 minutes.

The thus-obtained mug carrying a polka dot pattern was excellent in bond strength and warm water resistance of the design.

The transfer paper obtained in the example showed no problem, even after prolonged storage.

Example 10

One-hundred parts of an epoxy resin ("Epikote 828" (trade mark), product of Yuka Shell Epoxy K. K.), 5 parts of a reactive diluent ("Cardura" (trade mark), product of Yuka Shell Epoxy K. K.), 0.5 part of a defoaming agent ("BYK-077" (trade mark), product of BYK Chemie Japan), 10 parts of coloring pigment 2 and 30 parts of coloring pigment 4 were mixed under stirring, followed by adding 25 parts of a curing agent ("Epicure U" (trade mark), product of Yuka Shell Epoxy K. K.) to provide an ink composition.

Using the ink composition, the procedure described in Example 9 was otherwise repeated to provide a transfer paper and the transfer of the design to a substrate mug was carried out.

The mug carrying a polka dot pattern, thus manufactured, was pink-colored at room temperature but when filled with cold water, turned blue.

The thus-obtained mug carrying a polka dot pattern was excellent in bond strength and warm water resistance of the design.

The transfer paper obtained in the example showed no problem, even after prolonged storage.

Example 11

Using a blue oil based ink (trade mark "Sericol PS391", Teikoku Ink Seizo K. K.), a polka dot pattern was formed on the releasable base by screen reverse printing and a transfer paper was then manufactured in otherwise the same manner as Example 1.

Using this transfer paper, the transfer of the design to a substrate mug was performed in otherwise the same manner as described in Example 1.

The thus-obtained mug was excellent in bond strength and warm water resistance of the design.

Comparative Example 10

Using a transfer paper manufactured in the same manner as Example 1, the design was transferred to a substrate mug and the mug was then heated at 200° C. for 10 minutes.

The mug thus obtained was poor in bond strength and warm water resistance of the design. This is probably because the thermosetting resin adhesive was degraded by the high temperature applied.

Comparative Example 11

Using a transfer paper manufactured in the same manner as Example 1, the design was transferred to a substrate mug but no heating was performed.

This mug was poor in bond strength and warm water resistance of the design.

Example 12

A transfer paper was munufactured in the same manner as Example 1 except that 1 part of a silane coupling agent was added to the thermosetting adhesive composition of Example 1. Using this transfer paper, the design was transferred to a substrate mug.

The resulting mug was excellent in bond strength and warm water resistance of the picture.

Example 13

A transfer paper was munufactured in the same manner as Example 1 except that 1 part of a silane coupling agent was added to the thermosetting adhesive composition of Example 2. Using this transfer paper, the design was transferred to a substrate mug.

The resulting mug had been further improved in bond strength and warm water resistance of the design.

Example 14

A transfer paper was munufactured in the same manner as Example 1 except that 1 part of a silane coupling agent was added to the thermosetting adhesive composition of Example 9. Using the transfer paper, the design was transferred to a substrate mug.

The resulting mug had been further improved in bond strength and warm water resistance of the design.

Example 15

A transfer paper was munufactured in the same manner as Example 1 except that 1 part of a silane coupling agent was added to the thermosetting adhesive composition of Example 10. Using this transfer paper, the design was transferred to a substrate mug.

The resulting mug had been further improved in bond strength and warm water resistance of the design.

Example 16

A transfer paper was manufactured in the same manner as Example 1 except that 1 part of a silane coupling agent was added to the thermosetting adhesive composition of Example 11. Using this transfer paper, the design was transferred to a substrate mug.

The resulting mug had been further improved in bond strength and warm water resistance of the design.

Example 17

A design was formed on a substrate mug in the same manner as Example 1 except that the substrate mug was pretreated with a 1% aqueous solution of an epoxysilane coupling agent ("KBM303" (trade mark), Shin-Etsu Chemical Co., Ltd.). The resultant mug had been further improved in bond strength and warm water resistance of the design transferred.

Reference Example 1

The bond strength, warm water resistance and water resistance of the mugs manufactured in the above examples and comparative examples were evaluated as follows. However, the evaluation of adhesion was not performed for the mugs manufactured in the comparative examples.

(a) Bond strength

Using a cutting knife, the design (10 mm × 10 mm) on the mug was cut in longitudinal and lateral directions (cross-cut, 11 parallel lines) at 1 mm pitches to form 100 squares. An adhesive tape was applied to the cross-cut design and, then, pulled and the number of residual squares was counted.

(b) The mug carrying a transferred design was immersed in warm water at 80° C. for 30 minutes. Then, in the same manner as the bond strength test, the design was cross-cut and the number of residual squares was counted.

(c) Water resistance

The mug carrying a transferred design was immersed in water at room temperature for 24 hours. Then, in the same manner as the bond strength test, the design was cross-cut and the number of residual squares was counted.

(d) Adhesion

The mug carrying a transferred design was immersed in warm water at 80° C. for 2 hours. Then, in the same manner as the bond strength test, the picture was cross-cut and the number of residual squares was counted.

The results are shown in Table 1.

TABLE 1

| | Bond strength | Resistance to warm water | Water resistance | Adhesion |
|---|---|---|---|---|
| Example 1 | 100/100 | 100/100 | 100/100 | 97/100 |
| Example 2 | 100/100 | 100/100 | 100/100 | 96/100 |
| Comparative Example 1 | 100/100 | 0/100 | 100/100 | — |
| Comparative Example 2 | 100/100 | 0/100 | 0/100 | — |
| Comparative Example 3 | 100/100 | 0/100 | 0/100 | — |
| Comparative Example 4 | 40/100 | 0/100 | 10/100 | — |
| Comparative Example 5 | 20/100 | 0/100 | 0/100 | — |
| Example 3 | 100/100 | 100/100 | 100/100 | 100/100 |
| Example 4 | 100/100 | 100/100 | 100/100 | 98/100 |
| Comparative Example 6 | 100/100 | 50/100 | 80/100 | — |
| Example 5 | 100/100 | 100/100 | 100/100 | 98/100 |
| Example 6 | 100/100 | 100/100 | 100/100 | 100/100 |
| Comparative Example 7 | 50/100 | 10/100 | 30/100 | — |
| Comparative Example 8 | 80/100 | 30/100 | 30/100 | — |
| Example 7 | 100/100 | 100/100 | 100/100 | 99/100 |
| Example 8 | 100/100 | 100/100 | 100/100 | 99/100 |
| Comparative Example 9 | 100/100 | 0/100 | 0/100 | — |
| Example 9 | 100/100 | 100/100 | 100/100 | 96/100 |
| Example 10 | 100/100 | 100/100 | 100/100 | 7/100 |
| Example 11 | 100/100 | 100/100 | 100/100 | 98/100 |
| Comparative Example 10 | 0/100 | 0/100 | 0/100 | — |
| Comparative Example 11 | 0/100 | 0/100 | 0/100 | — |
| Example 12 | 100/100 | 100/100 | 100/100 | 100/100 |
| Example 13 | 100/100 | 100/100 | 100/100 | 100/100 |
| Example 14 | 100/100 | 100/100 | 100/100 | 100/100 |
| Example 13 | 100/100 | 100/100 | 100/100 | 100/100 |
| Example 14 | 100/100 | 100/100 | 100/100 | 100/100 |
| Example 15 | 100/100 | 100/100 | 100/100 | 100/100 |
| Example 16 | 100/100 | 100/100 | 100/100 | 100/100 |
| Example 17 | 100/100 | 100/100 | 100/100 | 100/100 |

It is apparent from the data in Table 1 that the design formed using the transfer paper of the invention is excellent in bond strength, warm water resistance, water resistance and adhesion.

What we claimed is:

1. A transfer sheet comprising a releasable base and, as disposed successively thereon, at least one picture printing layer comprising a resin component and a pigment component, a thermosetting adhesive layer and a release layer, the thermosetting adhesive layer being formed of a composition comprising:

a) 0.01–5 parts by weight of a crosslinking or curing agent selected from the group of isocyanate compound, epoxy compound, metal compound and N-methylol compound, b) 0.1–20 parts by weight of a thermosetting resin selected from the group of epoxy resin, melamine resin, urea resin and modified resin thereof, and c) 100 parts by weight of an alkyl(meth) acrylate polymer.

2. The transfer sheet according to claim 1 wherein the resin component of the picture printing layer comprises an ultraviolet-curing resin.

3. The transfer sheet according to claim 1 or 2 wherein the picture printing layer comprises a nonvariable color layer.

4. The transfer sheet according to claim 1 or 2 wherein the picture printing layer comprises a reversible thermochromic layer.

5. The transfer sheet according to claim 1 or 2 wherein the picture printing layer comprises a nonvariable color layer and a reversible thermochromic layer.

6. The transfer sheet according to claim 1 wherein the picture printing layer contains a silane coupling agent.

7. The transfer sheet according to claim 1 wherein the thermosetting resin is an epoxy resin having a molecular weight of about 200–5000 and an epoxy equivalent of about 100–1000.

8. The transfer sheet according to claim 1 wherein the alkyl(meth)acrylate polymer has a molecular weight in the range of about $3\times10^5$–$1\times10^6$.

9. The transfer sheet according to any one of claims 1 to 8 wherein the picture printing layer is formed using an ink composition comprising 60–95 weight % of a resin component and 40–5 weight % of a pigment component, said resin component comprising (a) 20–90 parts by weight of at least one member selected from the group consisting of urethane (meth)acrylates in the molecular weight range of about 500–50000 and polyester(meth)acrylates in the molecular weight range of about 500–50000, (b) 80–10 parts by weight of at least one mono/polyfunctional monomer, and based on the above total of parts by weight, (c) 1–15 parts by weight of at least one photopolymerization initiator selected from the group consisting of acetophenone type, benzophenone type and thioxanthone type initiators.

10. A method for transfer printing employing a transfer sheet claimed in claim 1, which comprises peeling off the releasable base from the sheet, transferring the printing layer and thermosetting adhesive layer as a unit to a substrate and curing the adhesive layer at a temperature of 80°–170° C.

11. The method according to claim 10 wherein the substrate is pretreated with a silane coupling agent.

* * * * *